US006903732B2

(12) United States Patent
Adachi et al.

(10) Patent No.: US 6,903,732 B2
(45) Date of Patent: Jun. 7, 2005

(54) IMAGE DISPLAY DEVICE

(75) Inventors: Katsumi Adachi, Kashiba (JP); Kunio Sekimoto, Katano (JP); Atsuhiro Yamano, Kawanishi (JP); Hiroshi Takahara, Neyagawa (JP); Hitoshi Tsuge, Kadoma (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 217 days.

(21) Appl. No.: 10/047,560

(22) Filed: Jan. 14, 2002

(65) Prior Publication Data

US 2002/0163523 A1 Nov. 7, 2002

(30) Foreign Application Priority Data

Jan. 15, 2001 (JP) ..... 2001-006018

(51) Int. Cl.[7] ..... G09G 5/00

(52) U.S. Cl. ..... 345/204; 345/536; 345/530; 345/211

(58) Field of Search ..... 345/204, 211, 345/87, 98, 100, 530, 536, 555, 596, 616, 600, 605; 382/232, 233

(56) References Cited

U.S. PATENT DOCUMENTS 4,424,513 A * 1/1984 Hatao et al. ..... 345/208
5,495,346 A * 2/1996 Choi et al. ..... 358/3.13
5,530,797 A * 6/1996 Uya et al. ..... 345/532
5,640,175 A * 6/1997 Minakuchi et al. ..... 345/667
5,835,082 A * 11/1998 Perego ..... 345/555
6,151,074 A * 11/2000 Werner ..... 348/425.1
6,332,172 B1 * 12/2001 Iverson ..... 710/68
6,476,822 B1 * 11/2002 Burbank ..... 345/634
2003/0030618 A1 * 2/2003 Jones

* cited by examiner

*Primary Examiner*—Regina Liang
*Assistant Examiner*—Jennifer T Nguyen
(74) *Attorney, Agent, or Firm*—McDermott Will & Emery LLP

(57) ABSTRACT

An image display device comprises a first storage device (4) for storing an image data, an image processor (8) for reducing the number of bits of the image data, a second storage device (10) for storing the image data after being processed, a display device (12) for displaying the image data after being processed, a driver (14) for driving the display device (12) and a controller (16) for controlling the operation of the driver (14). The controller (16) determines whether the image data stored in the first storage device (4) is dynamic or static, and, in the case of a static image, after storing the signals corresponding to one frame of the image data in the second storage device (10), operates only the second storage device (10), the driver (14) and the display device (12). Thereby, reduction of power consumption can be achieved while maintaining high image quality.

7 Claims, 4 Drawing Sheets

IMAGE DISPLAY DEVICE

TECHNICAL FIELD

The present invention relates to an image display device, particularly an image display device which can switch between the display of dynamic images and static images.

BACKGROUND ART

Development of communication technology, etc. in recent years makes it possible to provide information display devices for use in personal computers, portable information terminals and the like which can switch between the display of dynamic images and static images in accordance with the signal received This makes it possible to provide various kinds of information depending upon the user's needs and preference. However, in such an image display device, electricity consumption is increased because an on-off action is repeated whenever a dynamic image is displayed. A portable information terminal uses a battery as a driving power source thereof, and therefore reducing the amount of energy used is a particularly important object because an increase in energy consumption results in a shortened usage duration per charge.

A method for reducing the number of bits of image data has been proposed for reducing energy consumption in image display devices. As an example of an image display device provided with an image processing device which performs such processing, FIG. 4 shows a structure disclosed in Japanese Unexamined Patent Publication No. 1997-101771.

As shown in the figure, an image display device 50 comprises a video controller 51 for controlling the image display device 50, a VRAM 52 for storing RGB image data, a liquid crystal display 53 for displaying the RGB image data and a liquid crystal controller 54 for controlling the liquid crystal display 53. The image display device 50 is connected to a personal computer 56 and an image processing device 58. When RGB image data is input from a hard disk drive (not shown) of the personal computer 56. the image processing device 58 reduces the size of the image data by masking the lowest three bits thereof which are nearly uninfluential on the quality of the display image, conducts scaling and subtractive color processing, and then outputs the image data to the image display device 50. As the subtractive color process, as disclosed in the above publication, a dither method, an error diffusion method and the like are known. The RGB image data input into the image display device 50 is transferred to the VRAM 52 and displayed on the liquid crystal display 53 controlled by the liquid crystal controller 54.

The above-described image display device saves energy by reducing the number of bits of the RGB image data in the image processing device 58; however, the image processing device 58 continues to operate while an image is displayed on the liquid crystal display 53 regardless of whether the image is dynamic or static. Therefore. there is room for further improvement in energy reduction.

DISCLOSURE OF THE INVENTION

The present invention provides an image display device which has reduced energy consumption while maintaining a high quality display image.

To achieve the object. the image display device of the invention comprises: a first storage device for storing image data: an image processing device for reducing the number of bits of the image data; a second storage device for storing the image data after being processed; a display device for displaying the image data after being processed; a display drive device for driving the display device; and a control device for controlling the display drive device. Upon determining whether the image data stored in the first storage device is dynamic or static, and, in the case of a static image, after storing the signals corresponding to one frame of the image data in the second storage device, the control device operates the control device operates only the second storage device, the display drive device and the display device.

In the image display device, it is preferable that the memory capacity of the second storage device be smaller than that of the first storage device. Thereby, the second storage device and the display drive device can be disposed on the same chip and united into one body achieving further power savings.

In the image processing device, it is preferable that the image be processed by a dither method or an error diffusion method. It is also preferable that the image processing device reduce the total number of bits of the three elements (RGB) of the image data in such a manner that the number of G bits becomes the largest and that of B bits becomes the smallest. Thereby, a high duality display image can be obtained.

The image processing device can also be structured so as to comprise a dynamic image processing device for reducing the number of bits of a dynamic image, a static image processing device for reducing the number of bits of a static image and a switching device for switching between the dynamic image processing device and the static image processing device. In this case, the control device determines whether the image data stored in the first storage device is that of a dynamic image or a static image, and by operating the switching device according to that determination, if the image data is that of a dynamic image, the dynamic image processing device is made to process the image data, and if the image data is that of a static image, the static image processing device is made to process the image data. It is preferable that the dynamic image processing device process the image by an FRC method and the static image processing device process the image by a dither method or an error diffusion method.

BEST MODE FOR CARRYING OUT THE INVENTION

Figure 1:
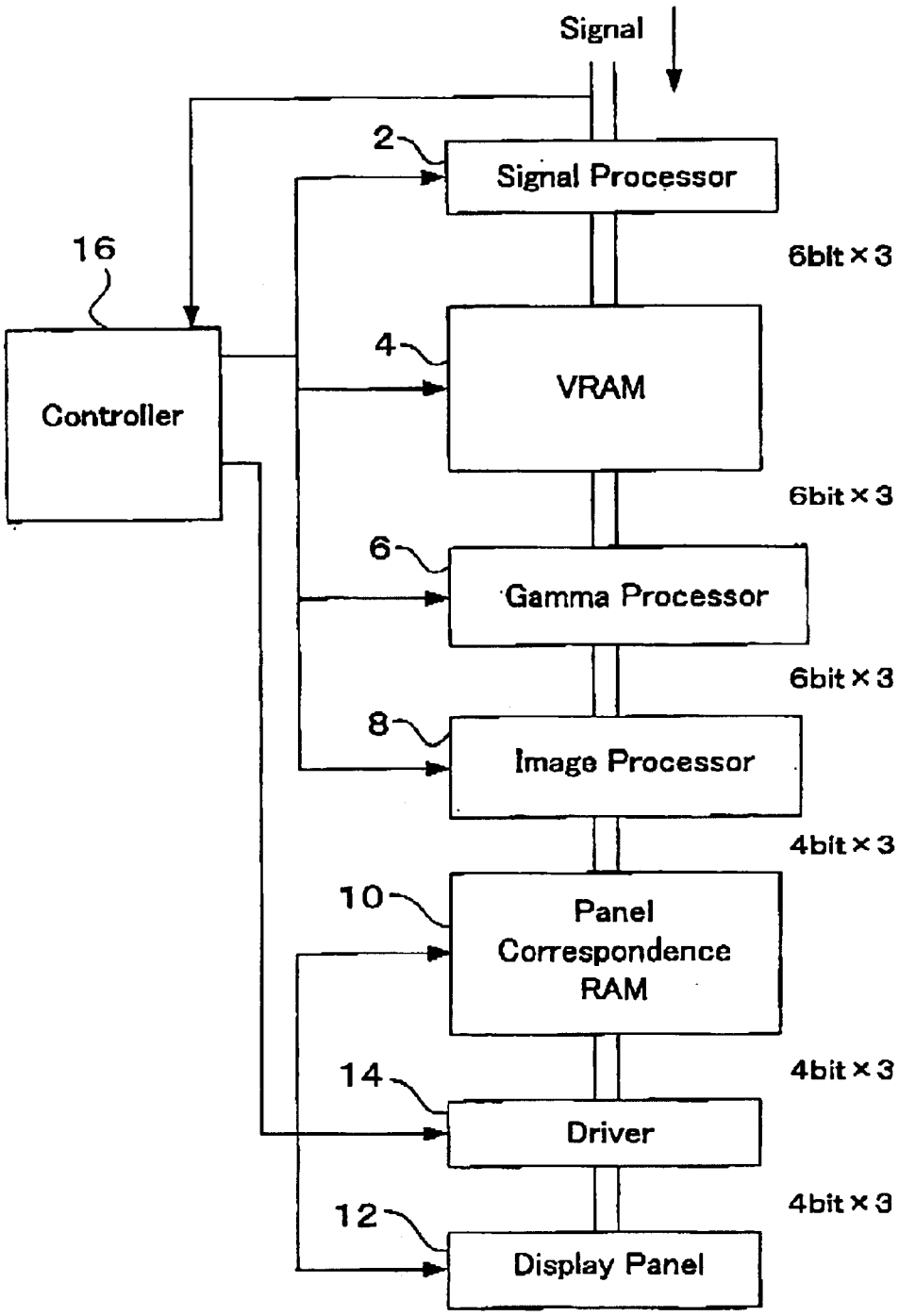
FIG. 1 is a schematic block diagram showing an image display device in accordance with one embodiment of the present invention.

Embodiments of the invention will be described below with reference to the accompanying drawings. FIG. 1 is a schematic block diagram showing an image display device in accordance with one embodiment of the invention. This image display device can be mounted on a portable information terminal, etc.

As shown in FIG. 1. the image display device comprises a signal processor 2 for outputting a digital image data based on the signals input thereinto, a VRAM 4 serving as a first storage device for storing the image data, a gamma processor 6 (γ processor) for correcting the γ property of the image data, an image processor 8 for reducing the size of the image data by reducing the number of bits thereof. a panel correspondence RAM 10 serving as a second storage device for storing the reduced image data, a display panel 12 comprising a liquid crystal panel for displaying the image data and a driver 14 for driving the display panel 12. The operations of the signal processor 2, the VRAM 4, the γ processor 6, the image processor 8, the panel correspondence RAM 10. the panel display 12 and the driver 14 are controlled by the controller 16. The signal processor 2 comprises a DSP (Digital Signal Processor) and has a function for decompressing compressed data based on the MPEG (Moving Picture Experts Group) standards, etc.

The operation of the image display device will be explained below. The signals demodulated after having been input through an antenna (not shown) are input into the signal processor 2 and subjected to digital signal processing, and then stored in the VRAM 4. Based on the signals input into the signal processor 2, the controller 16 determines whether the image data is dynamic or static and controls the image display device according to that determination. Here, a dynamic image data comprising three elements, i.e., R (red), G (green) and B (blue). each having 6 bits is stored in the VRAM 4. When the controller 16 determines that the image data is dynamic, it operates the signal processor 2. the VRAM 4, the γ processor 6. the image processor 8, the panel correspondence RAM 10, the display panel 12 and the driver 14.

The image data stored in the VRAM 4 is subjected to γ correction in the γ processor 6 in accordance with the prescribed γ correction data, and then is input into the image processor 8. The image processor 8 reduces the number of bits of the image data in accordance with the prescribed image processing method. As the image processing method, widely known methods can be used in which the number of gradations of the image data is reduced. For example, it is possible to simply cut off the lower bits. However, a contour line may appear caused by the reduced number of gradations, therefore it is desirable that the subtractive color process be conducted by a dither method or an error diffusion method. The dither method is a technique whereby the number of gradations of the image data is reduced while being compared with the threshold value of a prescribed dither matrix. The error diffusion method is a technique whereby the errors arising when reducing the number of gradations are dispersed among the adjacent pixels. These methods can prevent contour lines caused by the reduced number of gradations. According to the present embodiment of the invention, each channel of the RGB image data is reduced from 6 bits to 4 bits by the image processor 8 and stored in the panel correspondence RAM 10.

The image data stored in the panel correspondence RAM 10 is displayed on the display panel 12 driven by the driver 14. The controller 16 controls the image display device in such a manner that the above operation is repeated when the image data is determined to be dynamic based on the signals input into the signal processor 2.

On the other hand, based on the signals input into the signal processor 2, when the controller 16 determines that the image data is static, it processes the signals corresponding to the first screen of the image (one frame) in the same manner as dynamic images as described above. Then, it halts the operation of the signal processor 2, the VRAM 4, the γ processor 6 and the image processor 8, and operates only the panel correspondence RAM 10, the display panel 12 and the driver 14. Thereby, on the screen of the display panel 12, the static image first displayed is maintained. The image display device is kept controlled in this manner until the controller 16 recognizes dynamic image data based on the input signals.

As described above, when the image display device according to the present embodiment of the invention displays a static image, it operates only the minimum constituent components required to maintain the display image. Therefore, it exhibits reduced power consumption compared to the heretofore known devices, which operate the same way regardless of whether the image is dynamic or static.

Particularly, according to the present embodiment of the invention, since the panel correspondence RAM 10 stores the image data after the image processor 8 has reduced the number of bits, the memory capacity of the panel correspondence RAM 10 can be smaller than that of the VRAM 4. Therefore, when a static image is displayed while operating the panel correspondence RAM 10 without operating the VRAM 4, further power consumption savings are realized.

As described above, the memory capacity of the panel correspondence RAM 10 can be smaller, and this enables the panel correspondence RAM 10 and the driver 14 to be readily united into one body on a single IC chip. Thereby, the stray capacitance between the panel correspondence RAM 10 and the driver 14 can be lowered, and this arrangement achieves further power consumption savings. Note that, the γ processor 6 and the image processor 8 can also be united into one body on a single IC chip, and the versatility thereof is improved by internally storing its interface.

One embodiment of the invention is described above; however, embodiments of the invention are not limited to this explanation. For example, according to the present embodiment of the invention, the γ correction is conducted in the γ processor 6 before processing the image in the image processor 8. However, instead of having the γ processor 6, a structure where the driver 14 functions as a γ corrector and the image data of the VRAM 4 is directly input into the image processor 8 is also possible. Furthermore, the present embodiment is structured so that the signal processor 2 and the VRAM 4 are separate; however, it is also possible that the signal processor 2 contain the VRAM 4.

The processing method employed in the image processor 8 is not limited to that used in the present embodiment. A method is acceptable as long as it reduces the number of bits of the image data and the number of reduced bits can be suitably selected depending on the capacity of the display panel 12. For example, in the present embodiment, the number of bits of the processed image is the same in each of the three elements (RGB). However, it is also possible to make the number of bits of G, to which the human eye has a high sensitivity, the largest and that of B, to which the human eye has a low sensitivity, the smallest.

Figure 2:
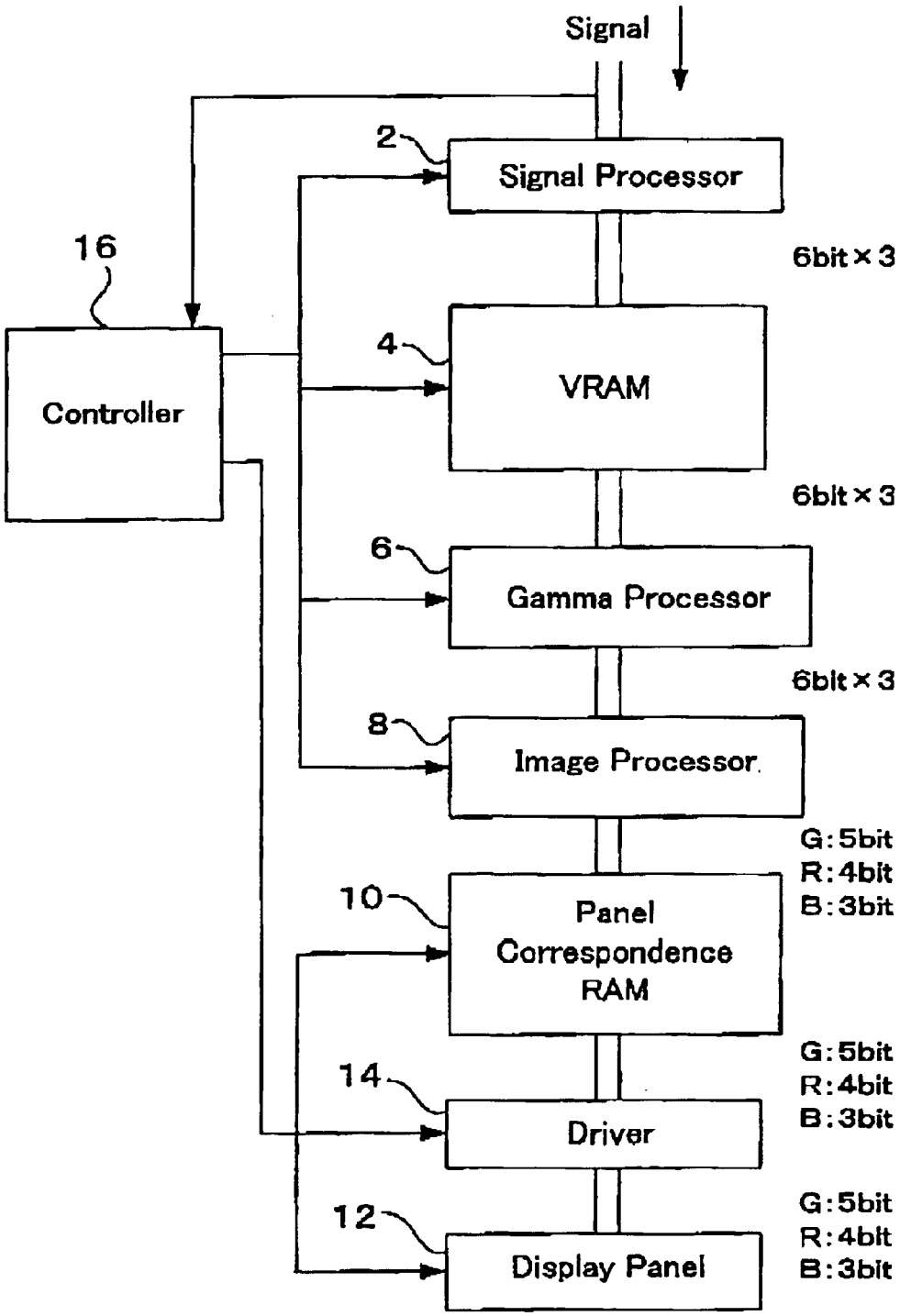
FIG. 2 is a schematic block diagram showing an image display device in accordance with another embodiment of the present invention.

For example, as shown in FIG. 2, it is preferable that the number of bits after being processed in the image processor 8 be G: 5 bits, R: 4 bits and B: 3 bits. Such an image processing technique is particularly effective for the dither method and the error diffusion method where the gradations of the image are spatially dispersed. Roughness of the image surface will be prevented even if the total number of bits of the three elements (RGB) is the same as the present embodiment. Therefore, a high quality image can be maintained even when the number of bits is reduced for reducing power consumption.

Figure 3:
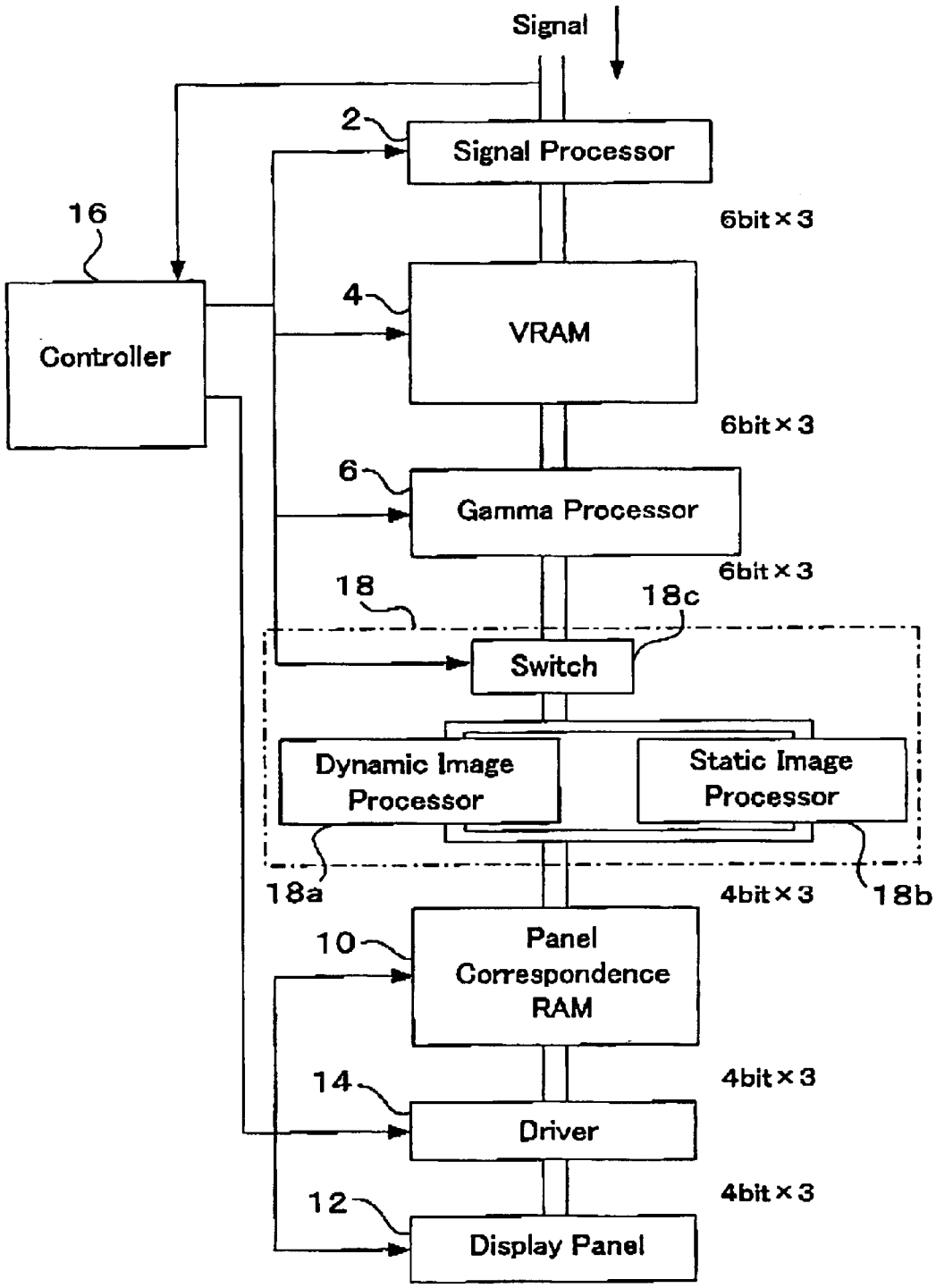
FIG. 3 is a schematic block diagram showing an image display device in accordance with still another embodiment of the present invention.
Figure 4:
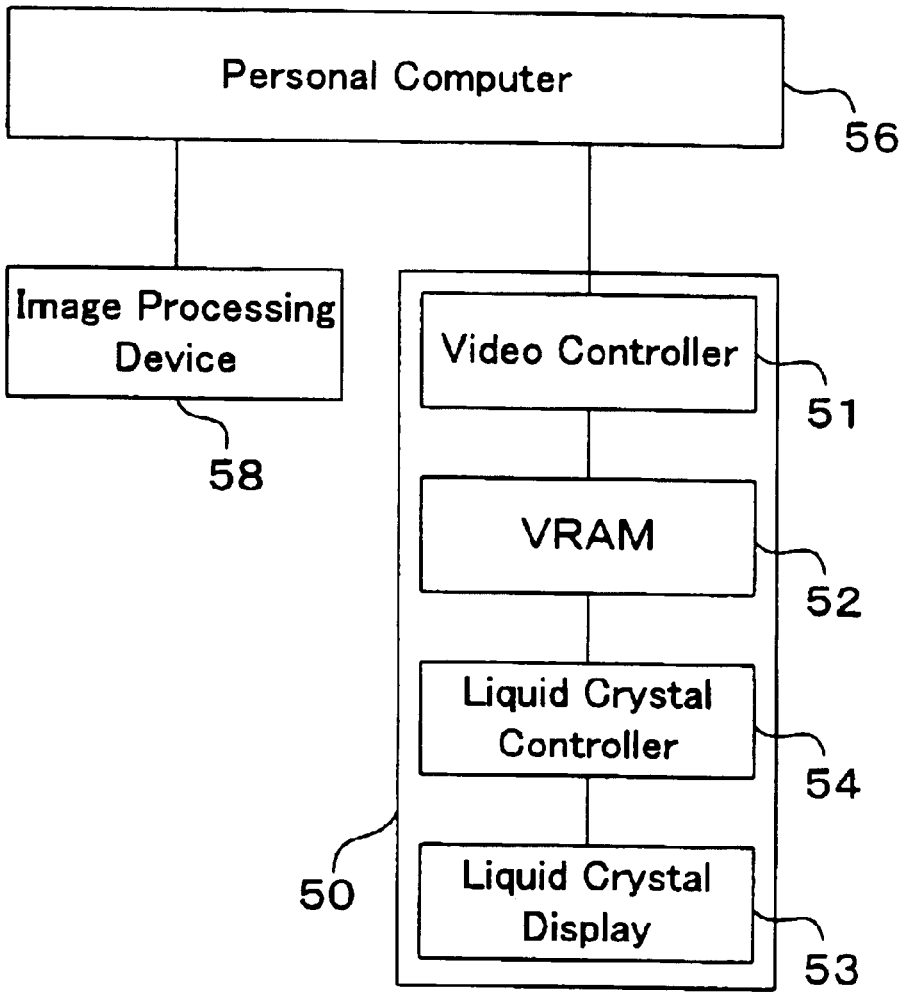
PRIOR ART Fig.4
FIG. 4 is a schematic block diagram showing a known image display device.

In the present embodiment, the image processor 8 processes dynamic and static image data in the sane manner; however, as shown in FIG. 3, it is also possible that the image processor 18 have a dynamic image processor 18*a*, a static image processor 18*b* and a switch 18*c*.

In this structure, the controller 16 determines whether the image data is that of a dynamic or static image based on the signals input into the signal processor 2. Then, the controller 16 operates the switch 18*c* according to that determination and selects either the dynamic image processor 18*a* or the static image processor 18*b*. Thereby, the image data processed in the γ processor 6 is, processed by the dynamic image processor 18*a* if it is dynamic image data, and processed by the static image processor 18*b*, if it is static image data. When a static image is displayed. the controller 16 operates the entire image display device until the signals corresponding to one screen (one frame) of the image data are stored in the panel correspondence RAM 10 and displayed on the display panel 12, and then operates only the panel correspondence RAM 10, the display panel 12 and the driver 14.

Thereby, the image processing method can be altered depending on whether the image is dynamic or static. This makes it possible to process both kinds of image in a suitable manner, resulting in reduced power consumption while maintaining high image quality. In addition, because the frame rates for displaying dynamic images and static images can be differentiated, by lowering the frame rate used for static images compared to that of dynamic images, reduction of power consumption can be achieved while maintaining high image quality. As an example of the image processing method, a spatial subtractive color process such as the dither method or the error diffusion method is effective in the static image processor 18*b*. In the dynamic image processor 18*a*, a temporal subtractive color process such as the FRC (Frame Rate Control) method is effective. The FRC method is a technique wherein the average voltage applied is controlled for displaying multiple gradations by inserting OFF-frames between ON-frames at a fixed rate when an arbitrary pixel of the display panel 12 is to be turned on.

According to the present embodiment, a liquid crystal panel is used as the display panel 12. However, reduction of power consumption as in the present embodiment can be also achieved by using light emitting displays such as organic EL and the like as the display panel 12.

Further, other kinds of rewritable semiconductor memory can also be used as the VRAM 4 and the panel correspondence RAM 10.

What is claimed is:

1. An image display device comprising:

a first storage device for storing an image data;

an image processing device for reducing the number of bits of the image data;

a second storage device for storing the image data after being processed;

a display device for displaying the image data after being processed;

a display drive device for driving the display device; and a control device for controlling the operation of the display drive device, wherein the control device determines whether the image data stored in the first storage device is dynamic or static, and, in the case of a static image, after storing the signals corresponding to one frame of the image data in the second storage device, operates only the second storage device, the display drive device and the image display device, and wherein the second storage device has a smaller memory capacity than the first storage device.

2. The image display device according to claim 1, wherein the second storage device and the display drive device are united into one body by disposing them on the same chip.

3. The image display device according to claim 1, wherein the image processing device processes the image data by a dither method or an error diffusion method.

4. The image display device according to claim 3, wherein the image processing device reduces the total number of bits of the three elements (RGB) contained in the image data in such a manner that, after conducting the image processing, the number of G bits becomes the largest and the number of B bits becomes the smallest.

5. The image display device according to claim 1, wherein the image processing device is provided with:

a dynamic image processing device for reducing the number of bits of a dynamic image data;

a static image processing device for reducing the number of bits of a static image data; and a switching device for switching between the dynamic image processing device and the static image processing device, wherein the control device determines whether the image data stored in the first storage device is that of a dynamic image or a static image, and by operating the switching device according to that determination, if the image data is that of a dynamic image, the dynamic image processing device is made to process the image data, and if the image data is that of a static image, the static image processing device is made to process the image data.

6. The image display device according to claim 5, wherein the dynamic image processing device processes the image by an FRC method, and the static image processing device processes the image by a dither method or an error diffusion method.

7. The image display device according to claim 1, wherein the image display device is a liquid crystal panel.

* * * * *